US010113749B2

(12) United States Patent
Yancey

(10) Patent No.: US 10,113,749 B2
(45) Date of Patent: Oct. 30, 2018

(54) PANEL ASSEMBLIES AND METHODS FOR FORMING PANEL ASSEMBLIES

(71) Applicant: General Electric Company, Schenectady, NY (US)

(72) Inventor: Martin Alan Yancey, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 471 days.

(21) Appl. No.: 14/837,044

(22) Filed: Aug. 27, 2015

(65) Prior Publication Data

US 2017/0059177 A1 Mar. 2, 2017

(51) Int. Cl.

| | |
|---|---|
| ***F24C 15/04*** | (2006.01) |
| ***F24C 15/02*** | (2006.01) |
| ***B21D 39/02*** | (2006.01) |
| ***B21D 39/03*** | (2006.01) |

(52) U.S. Cl.

CPC ..... *F24C 15/028* (2013.01); *B21D 39/021* (2013.01); *B21D 39/032* (2013.01)

(58) Field of Classification Search

CPC ..... B21D 39/021; B21D 39/032; F24C 15/02

USPC ..... 126/190

See application file for complete search history.

(56) References Cited

U.S. PATENT DOCUMENTS

| | | | | |
|---|---|---|---|---|
| 5,711,478 | A * | 1/1998 | Turecek | B65D 5/68 229/125.19 |
| 8,733,573 | B2 | 5/2014 | Lucht | |
| 2006/0277965 | A1* | 12/2006 | Durney | B21D 51/52 72/379.2 |
| 2017/0016625 | A1* | 1/2017 | Sanfrey | F24C 15/02 |

* cited by examiner

*Primary Examiner* — Jason Lau

(74) *Attorney, Agent, or Firm* — Dority & Manning, P.A.

(57) ABSTRACT

Panel assemblies, unformed panel assemblies, and methods for forming panel assemblies are provided. A panel assembly includes a main panel extending within a plane which defines an X-axis and a Y-axis, a first side panel extending from the main panel generally along a Z-axis, and a second side panel extending from the main panel generally along the Z-axis. The panel assembly further includes a first tab extending from the first side panel and including a first portion and a second portion, the first portion extending from the first side panel generally along the X-axis, the second portion extending from the first portion generally along the Z-axis such that a slot is defined between the second portion and the first side panel. The panel assembly further includes a second tab extending from the second side panel generally along the Y-axis and through the slot.

10 Claims, 5 Drawing Sheets

PANEL ASSEMBLIES AND METHODS FOR FORMING PANEL ASSEMBLIES

FIELD OF THE INVENTION

The present disclosure relates generally to panel assemblies, such as for oven appliance doors, and to methods for forming such panel assemblies. More specifically, the present disclosure relates to panel assemblies and formation methods that do not require secondary joining procedures.

BACKGROUND OF THE INVENTION

Panel assemblies are utilized during the assembly of many components, and typically form the outer surfaces of the components. A panel assembly accordingly includes a number of panels which can form the various outer surfaces of the resulting component. For example, a panel assembly can include an outer surface and one or more side surfaces that are generally perpendicular to the outer surface. One particular application of panel assemblies is in the assembly of doors, such as for appliances. Oven appliance doors, for example, utilize panel assemblies to form the outer surface and various side surfaces thereof.

In many cases, such as in the case of sheet-metal panel assemblies, the panel assemblies are provided for assembly in unformed "blanks" which include the various panels thereof. The panels must then be bent into the proper shape and fastened together using a secondary joining process such as welding, brazing, or connecting with suitable mechanical fasteners. However, such use of secondary joining processes is both expensive and time consuming, thus increasing the overall cost of the resulting component and the overall manufacturing time for the component.

Accordingly, improved panel assemblies and methods for forming such panel assemblies are desired. In particular, panel assemblies and associated methods which provide time and cost savings, and which do not require a secondary joining process, would be advantageous.

BRIEF DESCRIPTION OF THE INVENTION

Aspects and advantages of the invention will be set forth in part in the following description, or may be obvious from the description, or may be learned through practice of the invention.

In accordance with one embodiment, a method for forming a panel assembly is provided. The method includes receiving an unformed panel assembly. The unformed panel assembly includes a main panel extending within a plane which defines an X-axis and a Y-axis perpendicular to the X-axis, a first side panel extending generally within the plane from the main panel along the X-axis, and a second side panel extending generally within the plane from the main panel along the Y-axis. The unformed panel assembly further includes a first tab extending from the first side panel, the first tab including a first portion extending from the first side panel generally along the X-axis and a second portion extending from the first portion. The unformed panel assembly further includes a second tab extending from the second side panel generally along the X-axis. The method further includes bending the first tab such that the first portion extends from the first side panel generally along a Z-axis perpendicular to the X-axis and the Y-axis and the second portion extends from the first portion generally along the X-axis such that a slot is defined between the second portion and the first side panel. The method further includes bending the second tab such that the second tab extends from the second side generally along the Z-axis. The method further includes bending the first side panel such that the first side panel extends from the main panel generally along the Z-axis, and bending the second side panel such that the second side panel extends from the main panel generally along the Z-axis and the second tab extends through the slot.

In accordance with another embodiment, a panel assembly is disclosed. The panel assembly includes a main panel extending within a plane which defines an X-axis and a Y-axis perpendicular to the X-axis, a first side panel extending from the main panel generally along a Z-axis perpendicular to the X-axis and the Y-axis, and a second side panel extending from the main panel generally along the Z-axis, the second side panel generally perpendicular to the first side panel. The panel assembly further includes a first tab extending from the first side panel and including a first portion and a second portion, the first portion extending from the first side panel generally along the X-axis, the second portion extending from the first portion generally along the Z-axis such that a slot is defined between the second portion and the first side panel. The panel assembly further includes a second tab extending from the second side panel generally along the Y-axis and through the slot.

In accordance with another embodiment, an unformed panel assembly is disclosed. The unformed panel assembly includes a main panel extending within a plane which defines an X-axis and a Y-axis perpendicular to the X-axis, a first side panel extending generally within the plane from the main panel along the X-axis, and a second side panel extending generally within the plane from the main panel along the Y-axis. The unformed panel assembly further includes a first tab extending from the first side panel, the first tab including a first portion extending from the first side panel generally along the X-axis and a second portion extending from the first portion. The unformed panel assembly further includes a second tab extending from the second side panel generally along the X-axis. The main panel, first side panel, second side panel, first tab and second tab are integrally formed such that the unformed panel assembly is a monolithic structure, and the unformed panel assembly is formed from a metal.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
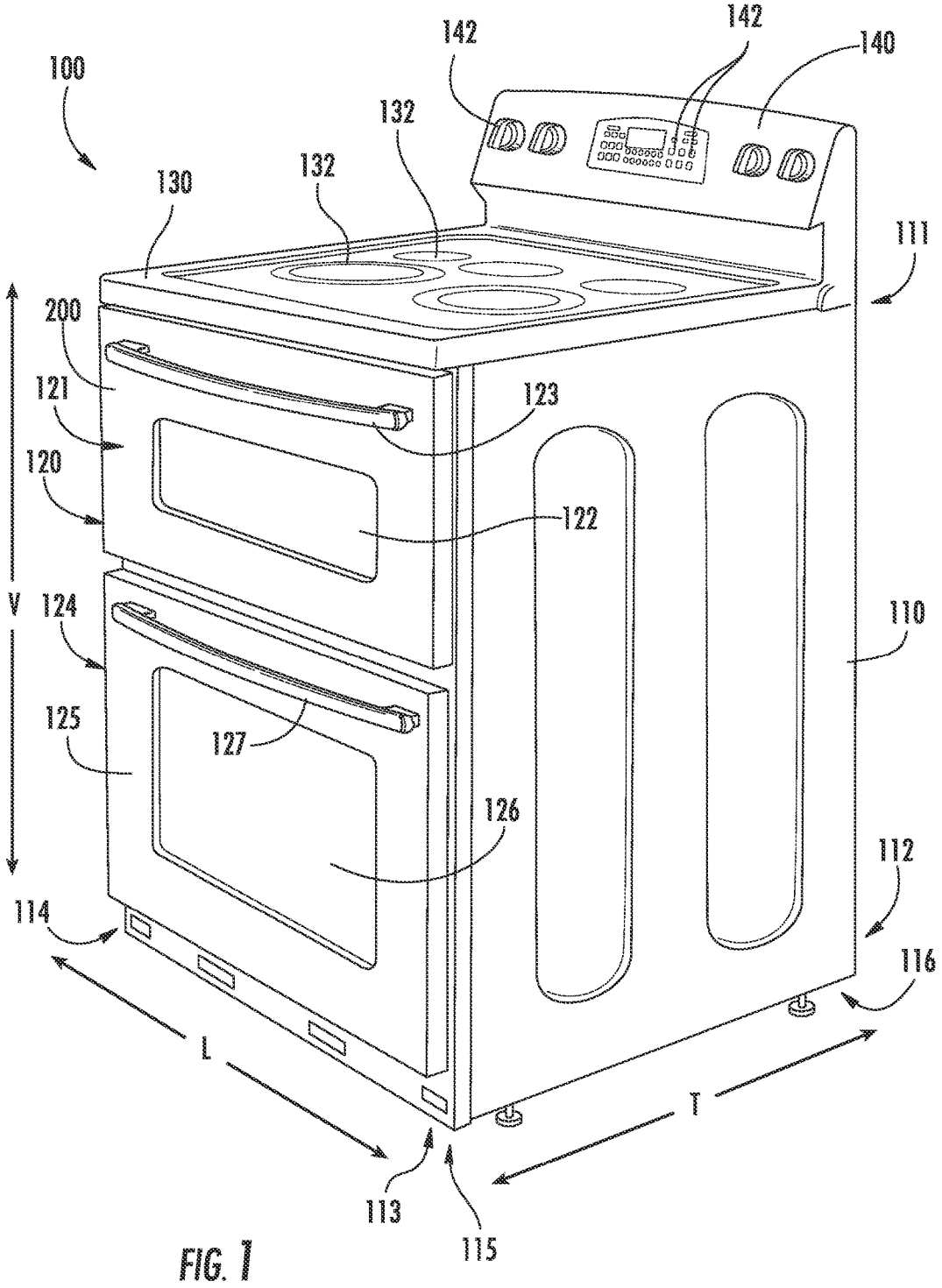
FIG. 1 is a perspective view of an oven appliance in accordance with one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
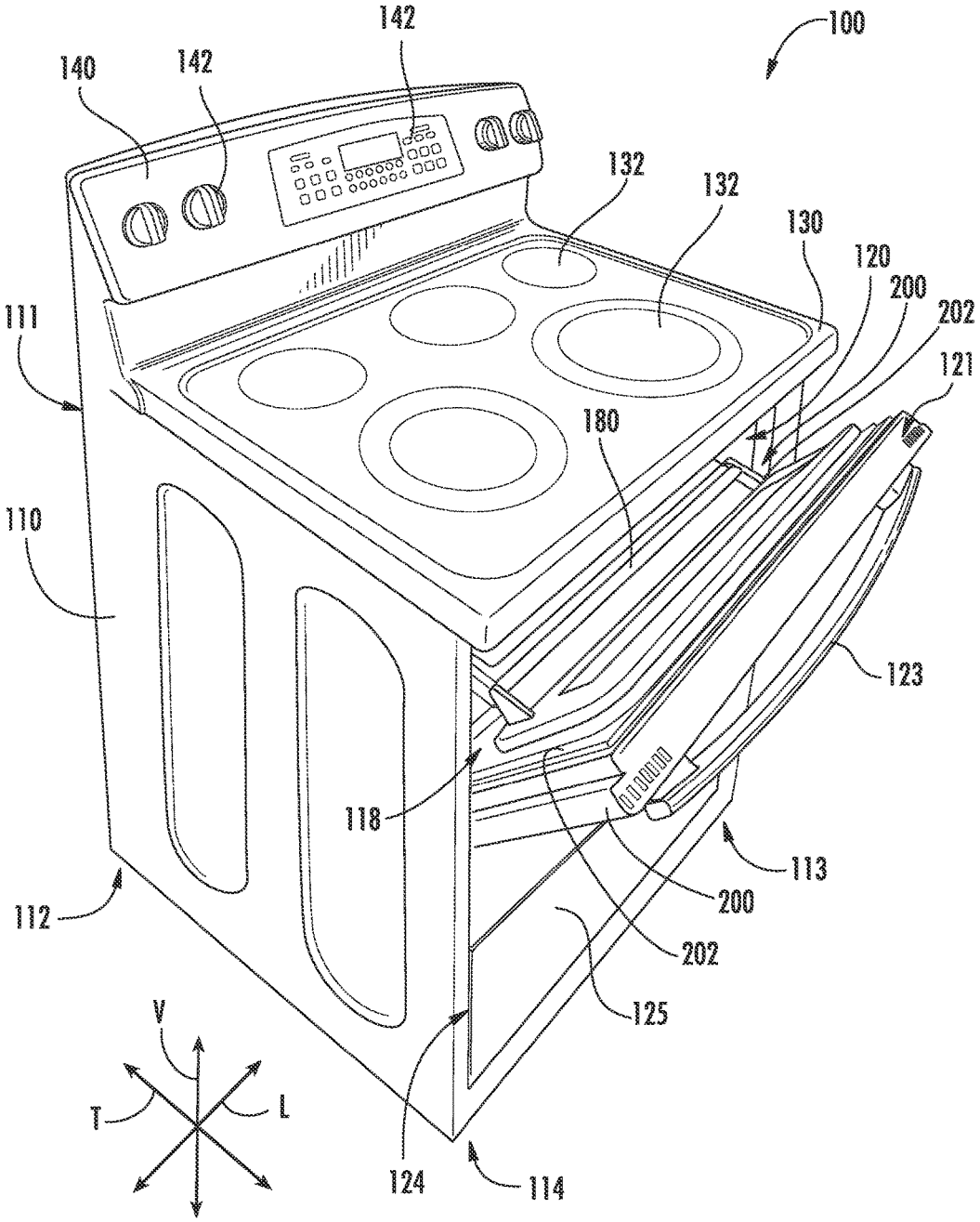
FIG. 2 is a perspective view of an oven appliance, with a door of the oven appliance opened, in accordance with one embodiment of the present disclosure.

FIGS. 1 and 2 provide perspective views of an oven appliance 100 according to exemplary embodiments of the present disclosure. Oven appliance 100 defines a vertical direction V, a lateral direction L and a transverse direction T. The vertical, lateral and transverse directions are mutually perpendicular and form an orthogonal direction system.

Oven appliance 100 includes an insulated cabinet 110. Cabinet 110 extends between a top portion 111 and a bottom portion 112, e.g., along the vertical direction V. Thus, top and bottom portions 111, 112 of cabinet 110 are spaced apart from each other, e.g., along the vertical direction V. Cabinet 110 also extends between a first side portion 113 and a second side portion 114, e.g., along the lateral direction L. Thus, first and second side portions 113, 114 of cabinet 110 are spaced apart from each other, e.g., along the lateral direction L. Cabinet 110 further extends between a front portion 115 and a back portion 116, e.g., along the transverse direction T. Thus, front and back portions 115, 116 of cabinet 110 are spaced apart from each other, e.g., along the transverse direction T.

Oven appliance 100 includes a cooktop 130 positioned at or adjacent top portion 111 of cabinet 110. Cooktop 130 includes various heating elements 132, such as gas burners, electric resistance elements, induction elements, etc., that are configured for heating cookware positioned thereon. As may be seen in FIG. 1, cabinet 110 also defines an upper cooking chamber 120 and a lower cooking chamber 124. Thus, oven appliance 100 is generally referred to as a double oven range appliance. As will be understood by those skilled in the art, oven appliance 100 is provided by way of example only, and the present subject matter may be used in any suitable oven appliance, e.g., a single oven range appliance, a single wall oven appliance, a double wall oven appliance, etc.

Upper cooking chamber 120 is positioned at or adjacent top portion 111 of cabinet 110. Conversely, lower cooking chamber 124 is positioned at or adjacent bottom portion 112 of cabinet 110. Thus, upper and lower cooking chambers 120, 124 are spaced apart from each other along the vertical direction V. Upper and lower cooking chambers 120, 124 can have any suitable size relative to each other. For example, as shown in FIG. 1, upper cooking chamber 120 may be smaller than lower cooking chamber 124.

Upper and lower cooking chambers 120, 124 are configured for receipt of one or more food items to be cooked. Oven appliance 100 includes an upper door 121 and a lower door 125 that are attached or coupled to cabinet 110, e.g., with slide assemblies and hinges, etc., in order to permit selective access to upper cooking chamber 120 and lower cooking chamber 124, respectively. Handles 123, 127 are mounted to upper and lower doors 121, 125 to assist a user with opening and closing doors 121, 125 in order to access cooking chambers 120, 124. As an example, a user can pull on handle 123 mounted to upper door 121 to open or close upper door 121 and access upper cooking chamber 120. Glass window panes 122, 126 provide for viewing the contents of upper and lower cooking chambers 120, 124 when doors 121, 125 are closed and also assist with insulating upper and lower cooking chambers 120, 124. Heating elements such as electric resistance heating elements, gas burners, microwave elements, etc., are positioned within upper and lower cooking chambers 120, 124 of cabinet 110 for heating upper and lower cooking chambers 120, 124.

A control panel 140 of oven appliance 100 is positioned at top portion 111 and back portion 116 of cabinet 110. Control panel 140 includes user inputs 142. Control panel 140 provides selections for user manipulation of the operation of oven appliance 100. For example, a user can touch control panel 140 to trigger one of user inputs 142. In response to user manipulation of user inputs 142, various components of the oven appliance 100, such as the heating elements, can be operated.

As may be seen in FIG. 2, cabinet 110 defines an opening 118 for accessing upper cooking chamber 120 of cabinet 110. Upper door 121 is positioned at or adjacent opening 118 of cabinet 110 when upper door 121 is in the closed position. Conversely, at least a portion of upper door 121 is spaced apart from cabinet 110, e.g., opening 118 of cabinet 110, along the transverse direction T when upper door 121 is in the open position.

When upper door 121 is in the closed position as shown in FIG. 1, upper door 121 seals or closes upper cooking chamber 120. Thus, such position and orientation of upper door 121 may be used when cooking food items within upper cooking chamber 120. If a user wants to check on the food items, the user may open upper door 121 (as illustrated in FIG. 2) in order to allow the user to view and observe the food items within upper cooking chamber 120.

A door such as door 121 (and/or door 124) may be formed from various components. For example, as shown, door 121 includes a front panel assembly 150 and a liner 152 which may define an interior of the door therebetween. The front panel 150 includes an outer panel of the door 121. A window pane 122 may be disposed within a window opening defined in the outer panel. Handle 123 extends from the front panel assembly 150. The liner 152 is generally a separate component coupled to the front panel assembly 150 to form the door 121. Liner 152 generally includes inner portions of the door 121 which are subjected to high temperatures in the cooking chamber 120 (or 124) during operation.

Oven appliance 100 also includes a rack assembly 180 that includes features for supporting food items thereon. Rack assembly 180 is slidably coupled to cabinet 110 such that rack assembly 180 can move along the transverse direction T.

Figure 3:
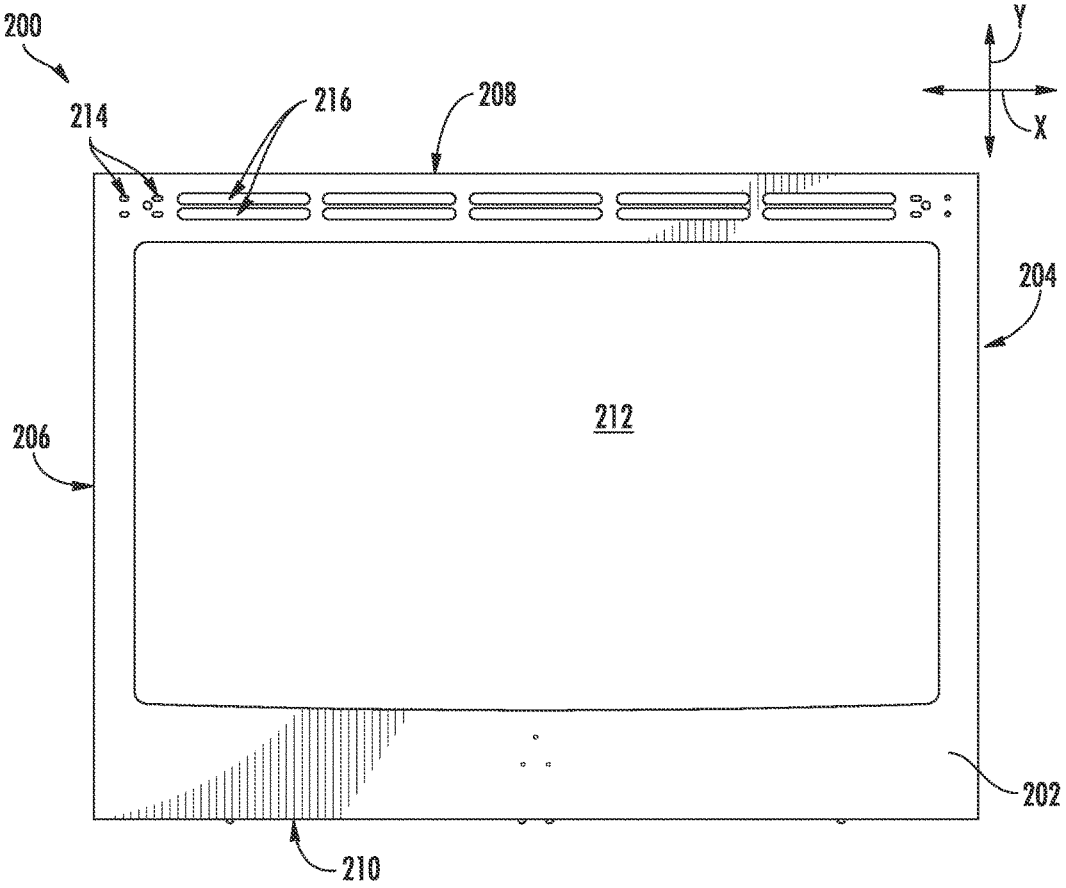
FIG. 3 is a front view of a front oven door panel assembly in accordance with one embodiment of the present disclosure.
Figure 4:
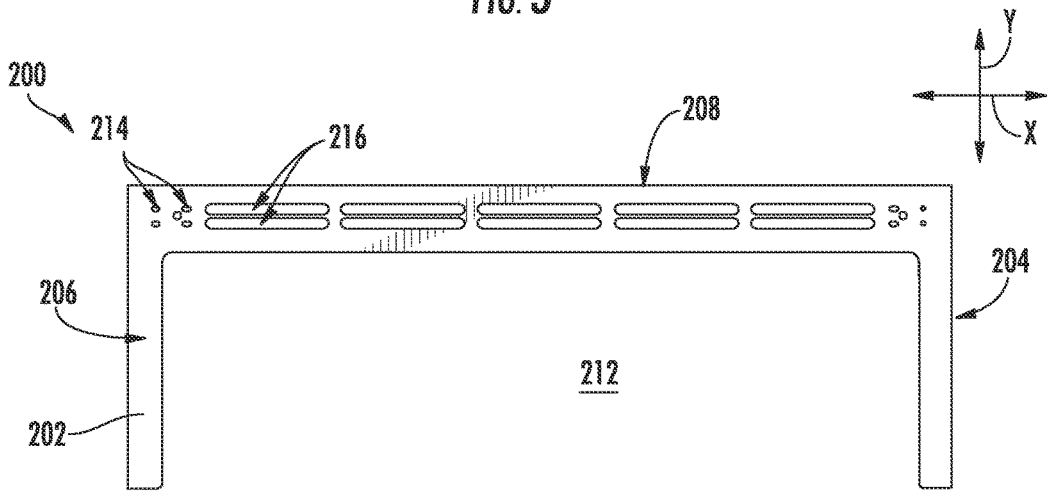
FIG. 4 is a front view of a front oven door panel assembly in accordance with another embodiment of the present disclosure.

Referring now to FIGS. 3 and 4, embodiments of a front panel assembly 200, which may for example be a front panel assembly 150 of a door 121 or door 125 of an oven appliance 100, are provided. FIG. 3 illustrates a full front panel assembly, which FIG. 4 illustrates a partial front panel assembly.

Front panel assembly 200 includes a main panel 202, which may for example be the front or outer panel thereof. Front panel assembly 200 may further include a plurality of side panels, such as a right side panel 204, left side panel 206, top side panel 208 and/or bottom side panel 210. The panel assembly 200 may define an X-axis, a Y-axis, and a Z-axis. The axes are mutually perpendicular and form an orthogonal coordinate system. Main panel 202 may extend within a plane that defines the X- and Y-axes, while the various side panels 204, 206, 208, 210 may extend from the main panel 202 generally along the Z-axis. Additionally, panels 204 and 206 may be generally parallel to each other, and panels 208 and 210 may be generally parallel to each other and generally perpendicular to panels 204 and 206.

Various openings may additionally be defined in the main panel 202. For example, a window opening 212 may be defined in the main panel 202 for accommodating one or more window panes therein. Handle openings 214 may be defined for extending mechanical fasteners therethrough to connect a handle to the front panel assembly 200. Vent openings 216 may be provided to vent air from the oven appliance 100 during operation.

Figure 5:
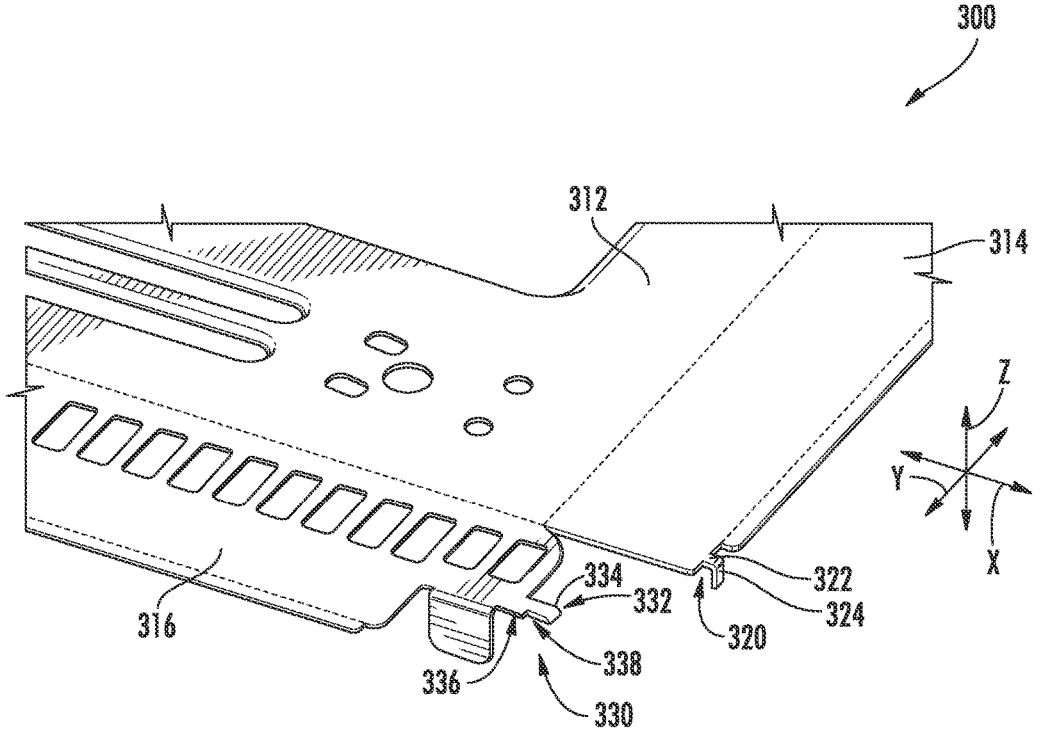
FIG. 5 is a front partial perspective view of an unformed panel assembly in accordance with one embodiment of the present disclosure.
Figure 8:
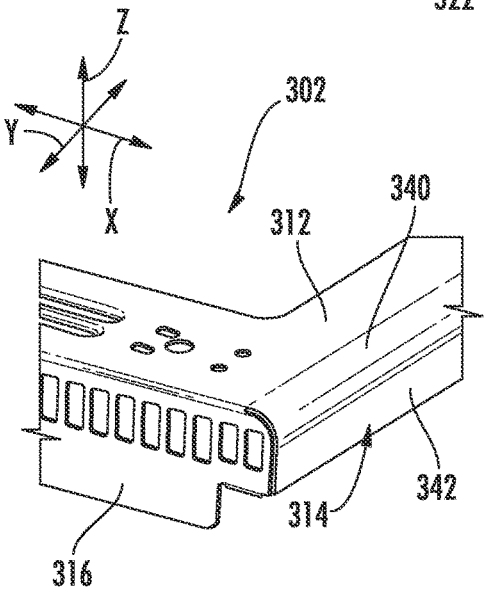
FIG. 8 is another front partial perspective view of an unformed panel assembly during formation into a panel assembly in accordance with one embodiment of the present disclosure.
Figure 9:
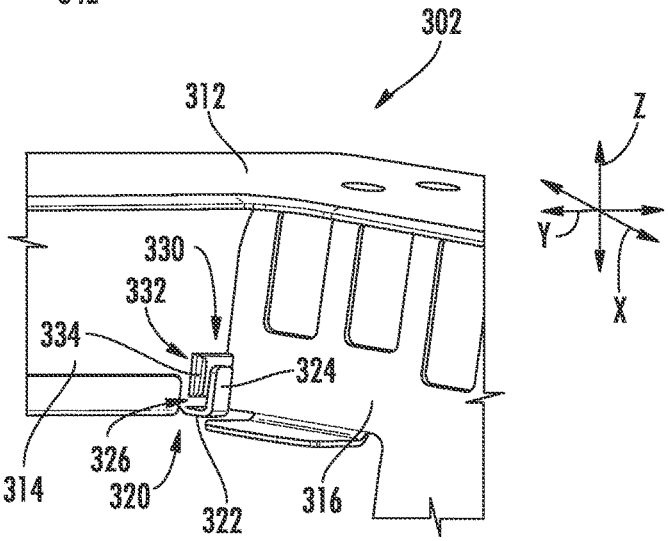
FIG. 9 is an opposing front partial perspective view of a panel assembly after formation in accordance with one embodiment of the present disclosure.

FIGS. 5 through 9 illustrate portions of an exemplary panel assembly at various stages during formation thereof. For example, FIG. 5 illustrates portions of an unformed panel assembly 300, i.e. before formation into a panel assembly. FIG. 9 illustrates a formed panel assembly 302. In some embodiments, panel assembly 302 is a front panel assembly 200 for a door 121, 125 of an oven appliance 100 and unformed panel assembly 300 is an unformed front panel assembly 200 for a door 121, 125 of an oven appliance 100. However, it should be understood that panel assemblies 302 in accordance with the present are not limited to such embodiments. Rather, panel assemblies 302 in accordance with the present disclosure may be utilized as components in any suitable doors or other assemblies for any suitable appliances or other applications.

As illustrated in FIG. 5, an unformed panel assembly 300 includes a main panel 312, a first side panel 314 and a second side panel 316. The main panel 312 extends within a plane which defines an X-axis and a Y-axis. The first side panel 314 extends generally within the X-Y plane from the main panel 312 along the X-axis, while the second side panel 316 extends generally within the X-Y plane from the main panel 312 along the Y-axis. Accordingly, first side panel 314 and second side panel 316 are generally perpendicular to each other.

Further, a first tab 320 may extend from the first side panel 314, and a second tab 330 may extend from the second side panel 316. The tabs may advantageously be utilized to join the first side panel 314 and second side panel 316 together during formation of the panel assembly 302 from the unformed panel assembly 300. Use of such tabs advantageously eliminates the need for a secondary joining process to join the side panels 314, 316, such that no secondary joining of the side panels 314, 316 is performed. A secondary joining process is any process wherein an additional fastening component, such as a mechanical fastener, a welding or brazing filler, etc., and/or additional alteration to the properties of the side panels 314, 316, such as melting, etc., is utilized to join the side panels 314, 316. Accordingly, formation of a panel assembly 302 in accordance with the present disclosure may advantageously be relatively more efficient and cost-effective.

The first tab 320 extends from the first side panel 314. First tab 320 may include a first portion 322 and a second portion 324. The first portion 322 may extend from the first side panel 314, such as generally along the X-axis as shown (and thus within the X-Y plane). The second portion 324 may extend from the first portion 322. For example, in some embodiments as shown, the second portion 324 may extend from the first portion 322 generally along the Z-axis. In other embodiments, the second portion 324 may extend from the first portion generally along the X-axis (and thus within the X-Y plane). The second tab 330 extends from the second side panel 316, such as generally along the X-axis (and thus within the X-Y plane) as shown.

Notably, in exemplary embodiments, the various components of an unformed panel assembly 300 and resulting formed panel assembly 302, such as the main panel 312, side panels 314, 316, first tab 320 and second tab 330, are formed from a suitable metal, such as aluminum, brass, copper, steel, tin, nickel, titanium, etc. Further, as illustrated, the various components of an unformed panel assembly 300 and resulting formed panel assembly 302, such as the main panel 312, side panels 314, 316, first tab 320 and second tab 330, are integrally formed as monolithic structure.

As discussed, the present disclosure is further directed to methods for forming panel assemblies 302. A method may include, for example, receiving an unformed panel assembly 300. A method may further include, for example, the step of bending the first tab 320. For example, and referring now to FIG. 6, the first portion 322 of the first tab 320 may be bent with respect to the first side panel 314 such that the first portion 322 extends from the first side panel 314 generally along the Z-axis, i.e. approximately 90 degrees. Further, after bending, the second portion 324 may extend from the first portion 322 generally along the X-axis, such that a slot 326 is defined between the second portion 324 and the first side panel 314. In some embodiments as shown, no bending of the second portion 324 relative to the first portion 322 is required. In other embodiments, bending of the second portion 324 relative to the first portion 322 is required.

Figure 6:
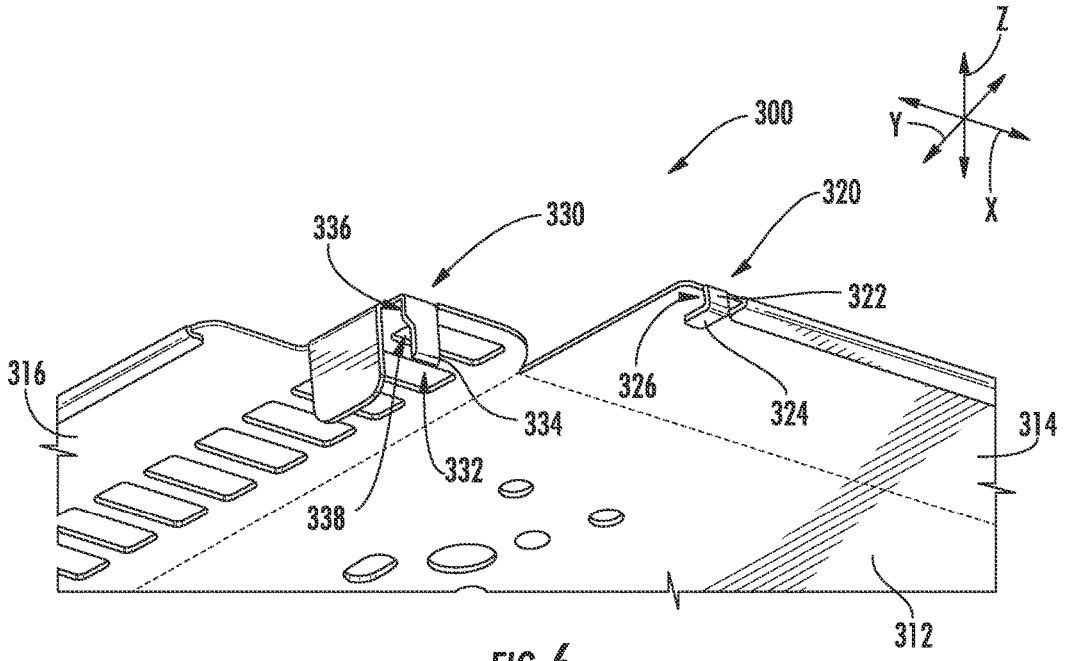
FIG. 6 is a rear partial perspective view of an unformed panel assembly during formation into a panel assembly in accordance with one embodiment of the present disclosure.
Figure 7:
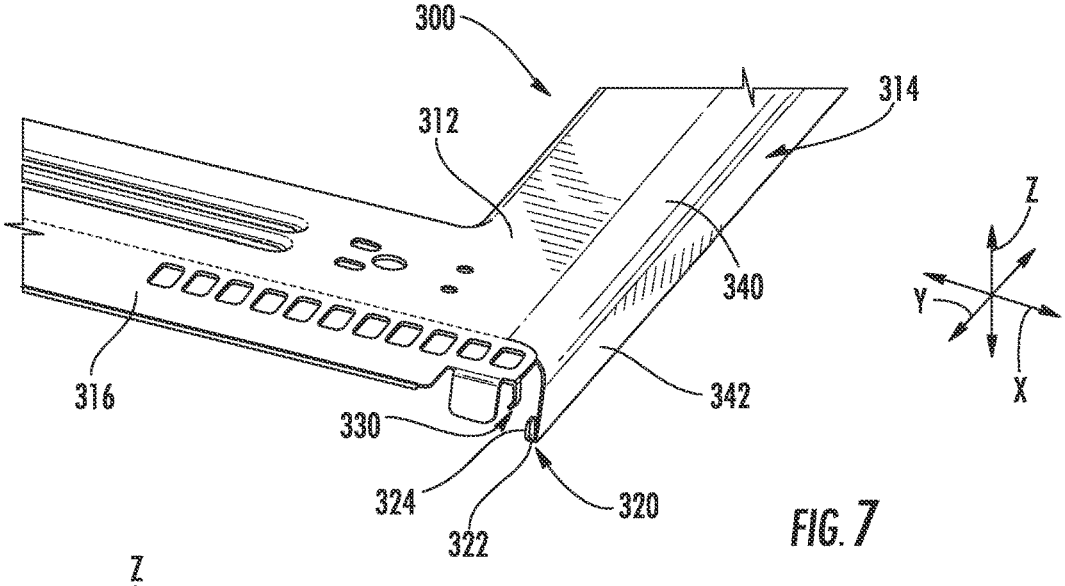
FIG. 7 is a front partial perspective view of an unformed panel assembly during formation into a panel assembly in accordance with one embodiment of the present disclosure.

Referring still to FIG. 6, a method may further include the step of bending the second tab 330. The second tab 330 may be bent with respect to the second side panel 316 such that the second tab 330 extends from the second side panel 316 generally along the Z-axis, i.e. approximately 90 degrees.

A method in accordance with the present disclosure may further include, for example, the steps of bending the first side panel 314 and bending the second side panel 316. Such steps may, in exemplary embodiments, occur after bending of the first tab 320 and bending of the second tab 330. For example, referring to FIG. 7, the first side panel 314 may be bent relative to the main panel 312 such that the first side panel 314 extends from the main panel 312 generally along the Z-axis. Notably, in some embodiments, first panel 314 after bending may include a curvilinear portion 340 extending from the main panel 312 and a linear portion 342 extending from the curvilinear portion 340. In these embodiments, at least the linear portion 342 may extend generally along the Z-axis.

In exemplary embodiments, the step of bending the second side panel 316 occurs after the step of bending the first side panel 314. Referring to FIG. 8, the second side panel 316 may be bent relative to the main panel 312 such that the second side panel 316 extends from the main panel 312 generally along the Z-axis. Further, and referring now to FIG. 9, such bending may cause the second tab 330 to extend into and through the slot 326. Such extension of the second tab 330 through the slot 326 may advantageously join the first side panel 314 and second side panel 316 together.

In exemplary embodiments, and referring still to FIG. 9, a method in accordance with the present disclosure may further include the step of bending the second portion 324 of the first tab 320 towards the second tab 330 after the second tab 330 is extended through the slot 326. Accordingly, the second portion 324 may contact the second tab 330 in the formed panel assembly 302. Such contact may advantageously further secure the joint between the first side panel 314 and second side panel 316.

Notably, in some embodiments, a distal end 332 of the second tab 330 comprises a radiused portion 334. This radiused portion 334 can advantageously further secure the joint between the first side panel 314 and second side panel 316. For example, when the second tab 330 is extended through the slot 326, the radiused portion 334 can protrude from the slot 326 and, when the second portion 324 contacts the second tab 330, can impede or prevent removal of the second tab 330 from the slot 326.

Further, in some embodiments, a side edge 336 of the second tab 330 can define a notched area 338. The notched area 338 can advantageously provide clearance for the second tab 330 over the first portion 322 of the first tab 320 as it is being inserted into and through slot 326.

Notably, bending of the various components as discussed herein can be performed by hand and/or via suitable mechanical bending apparatus, as desired or required. The unformed panel assembly 300 may, as desired, include scoring defined between and demarcating the various components thereof. Such scoring may assist in bends between the various components being located as desired or required to form a suitable panel assembly 302.

Accordingly, the present disclosure is further directed to panel assemblies 302 which may, for example, be formed utilizing methods as disclosed herein. A panel assembly 302 includes, for example, a main panel 312 extending within a plane which defines an X-axis and a Y-axis, a first side panel 314 extending from the main panel 312 generally along a Z-axis, and a second side panel 316 extending from the main panel 312 generally along the Z-axis. The second side panel 316 is generally perpendicular to the first side panel 314. The panel assembly 302 may further include a first tab 320 extending from the first side panel 314. The first tab 320 may include a first portion 322 extending from the first side panel 314 generally along the X-axis, and a second portion 324 extending from the first portion 322 generally along the Z-axis. A slot 326 may be defined between the second portion 324 and the first side panel 314. The panel assembly 302 may further include a second tab 330 extending from the second side panel 316 generally along the Y-axis. The second tab 330 extends through the slot 326 to join the side panels 314, 316 together. In exemplary embodiments, the second portion 324 contacts the second tab 330.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A panel assembly, comprising:

a main panel extending within a plane which defines an X-axis and a Y-axis perpendicular to the X-axis;

a first side panel extending from the main panel generally along a Z-axis perpendicular to the X-axis and the Y-axis;

a second side panel extending from the main panel generally along the Z-axis, the second side panel generally perpendicular to the first side panel;

a first tab extending from the first side panel and comprising a first portion and a second portion, the first portion extending from the first side panel generally along the X-axis, the second portion extending from the first portion generally along the Z-axis such that a slot is defined between the second portion and the first side panel; and a second tab extending from the second side panel generally along the Y-axis and through the slot, wherein a side edge of the second tab defines a notched area, wherein the notched area is positioned between the second tab and the first portion of the first tab within the slot along the Z-axis, wherein the notched area is open toward the first portion along the Z-axis, and wherein the notched area provides an open clearance for the second tab over the first portion of the first tab through the slot.

2. The panel assembly of claim 1, wherein the second portion of the first tab contacts the second tab.

3. The panel assembly of claim 1, wherein the main panel, first side panel, second side panel, first tab and second tab are integrally formed such that the panel assembly is a monolithic structure.

4. The panel assembly of claim 1, wherein the wherein the main panel, first side panel, second side panel, first tab and second tab are formed from a metal.

5. The panel assembly of claim 1, wherein the panel assembly is a front oven door panel assembly.

6. The panel assembly of claim 1, wherein a distal end of the second tab comprises a radiused portion.

7. The panel assembly of claim 1, wherein no secondary joining of the first side panel and the second side panel is performed.

8. An unformed panel assembly, comprising:

a main panel extending within a plane which defines an X-axis and a Y-axis perpendicular to the X-axis;

a first side panel extending generally within the plane from the main panel along the X-axis;

a second side panel extending generally within the plane from the main panel along the Y-axis;

a first tab extending from the first side panel, the first tab comprising a first portion extending from the first side panel generally along the X-axis and a second portion extending from the first portion; and a second tab extending from the second side panel generally along the X-axis, wherein the main panel, first side panel, second side panel, first tab and second tab are integrally formed such that the unformed panel assembly is a monolithic structure, wherein the unformed panel assembly is formed from a metal, wherein a side edge of the second tab defines a notched area parallel to the second tab within the plane from the main panel along the X-axis, wherein the notched area is open along the Y-axis in a direction opposite the second tab, and wherein the notched area provides an open clearance for the second tab over the first portion of the first tab through a slot.

9. The unformed panel assembly of claim 8, wherein the second portion of the unformed panel assembly extends from the first portion generally along the Z-axis.

10. The unformed panel assembly of claim 8, wherein the unformed panel assembly is an unformed front oven door panel assembly.

* * * * *